US010645969B2

(12) United States Patent
Caprini

(10) Patent No.: US 10,645,969 B2
(45) Date of Patent: May 12, 2020

(54) FILTER MANUFACTURING APPARATUS

(71) Applicant: PHILIP MORRIS PRODUCTS S.A., Neuchatel (CH)

(72) Inventor: Gianni Caprini, Zola Predosa (IT)

(73) Assignee: Philip Morris Products S.A., Neuchatel (CH)

( * ) Notice: Subject to any disclaimer, the term of this patent is extended or adjusted under 35 U.S.C. 154(b) by 126 days.

(21) Appl. No.: 15/778,292

(22) PCT Filed: Nov. 25, 2016

(86) PCT No.: PCT/EP2016/078767
§ 371 (c)(1),
(2) Date: May 23, 2018

(87) PCT Pub. No.: WO2017/089514
PCT Pub. Date: Jun. 1, 2017

(65) Prior Publication Data

US 2018/0343918 A1 Dec. 6, 2018

(30) Foreign Application Priority Data

Nov. 27, 2015 (EP) ..... 15196677

(51) Int. Cl.
*A24D 3/00* (2020.01)
*A24D 3/02* (2006.01)
(Continued)

(52) U.S. Cl.
CPC ..... *A24D 3/0279* (2013.01); *A24D 3/022* (2013.01); *A24D 3/0229* (2013.01); *A24D 3/10* (2013.01)

(58) Field of Classification Search
CPC ..... A24D 3/048; A24D 3/061
(Continued)

(56) References Cited

U.S. PATENT DOCUMENTS 3,624,722 A * 11/1971 Stone ..... A24D 3/0233 493/42
4,179,323 A 12/1979 Sigmon
(Continued)

FOREIGN PATENT DOCUMENTS

EP 2868215 5/2015
EP 2868215 A2 * 5/2015 ..... A24D 3/0291

OTHER PUBLICATIONS

PCT Search Report and Written Opinion for PCT/EP2016/078767, dated Mar. 8, 2017 (11 pages).

*Primary Examiner* — Andrew M Tecco
*Assistant Examiner* — Eyamindae C Jallow
(74) *Attorney, Agent, or Firm* — Mueting, Raasch & Gebhardt, P.A.

(57) ABSTRACT

The invention relates to a filter manufacturing apparatus (1) to form a hollow filter body, the filter manufacturing apparatus comprising: —a feed path adapted to continuously feed a filter material along a longitudinal transport direction (30); —a forming device (4) connected to a terminating end of the feed path and adapted to form the filter material into a hollow rod-shaped filter body and deliver the formed filter body, the forming device including: ■ a tubular forming element (8) adapted to allow the filter material to pass therethrough, ■ a pin (34) extending longitudinally within the tubular forming element, the pin having a pin diameter;—a diameter changing device (40), adapted to vary the pin diameter of the pin, so as to obtain a filter body having a through hole of variable diameter.

15 Claims, 3 Drawing Sheets

(51) Int. Cl.
*A24D 3/04* (2006.01)
*A24D 3/10* (2006.01)

(58) Field of Classification Search
USPC ..... 131/202, 215.2; 493/4, 39, 42, 48–50
See application file for complete search history.

(56) References Cited

U.S. PATENT DOCUMENTS

| | | | | | |
|---|---|---|---|---|---|
| 4,411,640 | A * | 10/1983 | Hall | A24D 3/0225 | 222/221 |
| 5,695,441 | A * | 12/1997 | Irikura | A24C 5/478 | 493/47 |
| 7,074,170 | B2 * | 7/2006 | Lanier, Jr. | A24D 3/022 | 493/39 |
| 7,381,175 | B2 * | 6/2008 | Dawson | A24D 3/061 | 493/47 |
| 9,380,809 | B2 * | 7/2016 | Davis | A24D 3/0212 | |
| 10,182,592 | B2 * | 1/2019 | Nakamura | A24D 3/022 | |
| 2014/0034571 | A1 | 2/2014 | Torai | | |

* cited by examiner

FILTER MANUFACTURING APPARATUS

This application is a U.S. National Stage Application of International Application No. PCT/EP2016/078767, filed Nov. 25, 2016, which was published in English on Jun. 1, 2017, as International Publication No. WO 2017/089514 A1. International Application No. PCT/EP2016/078767 claims priority to European Application No. 15196677.7 filed Nov. 27, 2015.

The present invention relates to an apparatus to manufacture hollow filters or hollow filter components. The hollow filters or hollow filter components are preferably used in an aerosol-forming article.

The production of filter rods starts from a filter material made of a mixture of various ingredients. The raw material for the manufacture of cigarette filters is commonly cellulose, for example obtained from wood. The cellulose is then acetylated, making it into a material called cellulose acetate or simply "acetate" for short, dissolved, and spun as continuous synthetic fibers arranged into a bundle called tow. This tow is generally opened, plasticized, shaped, and cut to length to act as a filter. The plasticizer dissolves the cellulose acetate fibers so that they stick together in a single unit by the action of pressure and heat so that the filter material solidifies and the filter rod is formed. Filters are commonly wrapped in a wrapping material, which in many cases includes a strip of paper.

Also the production of filters which are non-wrapped in the wrapping paper, are known. In the production of non-wrapped filter plugs, the filter material is shaped in the desired form in a forming unit. The material used and the process of shaping are so realized that the filter rod maintains its shape even after leaving the forming unit to a sufficient degree, so that the wrapping paper—otherwise used for shape stabilization—can be omitted. During the production of non-wrapped filter plugs, the filter material stream in the forming unit is subjected to pressure and heat. The necessary thermal energy can be introduced in various ways into the filter material, for example by hot-air, such as steam, or microwave energy.

Further, it is known to produce hollow filters, that is, filters which include a through hole passing through the filter along its longitudinal axis. In current known equipment, the internal hollow hole is realized by means of a pin which is positioned substantially coaxially to the forming unit. The diameter and position of the pin determine the internal hollow diameter of the hole in the filter rod. For each diameter of the through hole of the rod, a different pin having a different diameter is needed.

There is therefore a need for a apparatus for manufacturing filters or filter components which can provide wrapped or non-wrapped filters having an internal through hole which has a simplified structure and does not need the change of many parts during operation. Change of parts generally also implies a apparatus stop and production interruption. Therefore, there is also a need of increasing the productivity of the apparatus producing the hollow filters.

The invention may satisfy at least one of the above needs.

The invention relates to a filter manufacturing apparatus adapted to form a hollow filter body, the filter manufacturing apparatus comprising: a feed path adapted to continuously feed a filter material along a longitudinal transport direction; a forming device connected to a terminating end of the feed path and adapted to form the filter material into a hollow rod-shaped filter body and deliver the hollow rod-shaped formed filter body, the forming device including: a tubular forming element adapted to allow the filter material to pass therethrough, and a pin extending longitudinally within the tubular forming element, the pin having a pin diameter. Further, the apparatus comprises a diameter changing device, adapted to vary the pin diameter of the pin, so as to obtain a filter body having a through hole of variable diameter.

The hollow filter body, that is a filter having an inner through hole, is formed in the apparatus of the invention by means of a pin located inside a forming device. Due to the fact that a hollow filter body may be used as a component in a plurality of different products, it may be desired to change the diameter of the through hole depending on the final product in which the hollow filter is used. Preferably, the final product is an aerosol forming article. Thanks to the provision in the apparatus of the invention of a diameter changing device which allows the pin to change its diameter, the same pin can be used to produce hollow filters having different diameters of the through hole. Production interruptions in order to change pin with a pin of a different diameter are therefore avoided. The production of different parts such as a plurality of pins of different diameters is avoided as well.

The filter material which is used to realize a hollow filter body may comprise any suitable material or materials. Examples of suitable materials include, but are not limited to, cellulose acetate, cellulose, reconstituted cellulose, polylactic acid, polyvinyl alcohol, nylon, polyhydroxybutyrate, polypropylene, paper, thermoplastic material, such as starch, non-woven materials and combinations thereof. One or more of the materials may be formed into an open cell structure. Preferably, the filter material comprises cellulose acetate tow.

The filter material may include additional material, either in a final filter segment or in one or more additional elements incorporated in the filter. For example, the additional material may be incorporated into fibrous filter tow of the filter segment or in an additional filter element. For example, the filter material may include a sorbent material. The term "sorbent" refers to an adsorbent, an absorbent, or a substance that may perform both of these functions. The sorbent material may comprise activated carbon. The sorbent may be incorporated into the filter segment in which the capsule is embedded. More preferably, however, the sorbent is incorporated into an additional filter element upstream of the filter segment. Alternatively or additionally, the filter material may include an adhesive, a plasticizer or flavor release agent, or a combination thereof.

Preferably, the filter material includes a plasticizer, which has the function of a bonding constituent. In hollow filters components, the component includes a through hole which weakens the overall structure of the filter plug. In order to avoid deformations of the hollow filter component, for example by compression of the filter, it is preferred that the material in which the hollow filter is realized is stiffer than the material in which a standard filter plug is formed. For this purpose, a procedure similar to that used for the production of non-wrapped filters is preferably used also for the production of hollow filters, which can be wrapped or not.

The filter body produced with the apparatus of the invention may be then cut in portions to form filter components, which may therefore be wrapped or non-wrapped.

Preferably, the hollow filter body is a continuous body.

Preferably, the filter material is a filter tow material.

Filters realized with the apparatus of the invention may advantageously be used in aerosol-forming articles. Aerosol forming articles according to the present invention may be in the form of filter cigarettes or other smoking articles in which tobacco material is combusted to form smoke. The present invention additionally encompasses articles in which tobacco material is heated to form an aerosol, rather than combusted, and articles in which a nicotine-containing aerosol is generated from a tobacco material, tobacco extract, or other nicotine source, without combustion or heating. Aerosol forming articles according to the invention may be whole, assembled aerosol forming articles or components of aerosol forming articles that are combined with one or more other components in order to provide an assembled article for producing an aerosol, such as for example, the consumable part of a heated smoking device.

An aerosol forming article may be an article that generates an aerosol that is directly inhalable into a user's lungs through the user's mouth. An aerosol forming article may resemble a conventional smoking article, such as a cigarette and may comprise tobacco. An aerosol forming article may be disposable. An aerosol forming article may alternatively be partially-reusable and comprise a replenisheable or replaceable aerosol forming substrate.

The apparatus for manufacturing filters comprises a feed path to transport the filter material along a transport direction.

In order to shape the filter material, which preferably includes a plasticizer, into a filter body further used for the production of filters, a forming device connected to a terminating end of the feed path and adapted to form the filter material into a rod-shaped filter body and deliver the formed continuous filter body is used. The forming device comprises a tubular forming element adapted to allow the filter material to pass therethrough to form the filter material into the continuous filter body. The inner walls of the tubular forming element preferably define the outer surface of the continuous filter body and determine, among others, its diameter. The inner walls of the tubular forming element "compress" the filter material into a rod.

Advantageously, the tubular forming element defines an internal channel substantially of cylindrical cross section, having a longitudinal axis, connecting an inlet of the tubular forming element to an outlet of the same. The feed path preferably terminates at the inlet of the tubular forming element.

Further, the tubular forming element houses in its interior a pin. The pin is preferably located coaxially to the channel defined by the tubular forming element, that is, preferably channel and pin have the same longitudinal axis. Preferably, the pin is substantially rod-shaped and it defines an external surface which is substantially cylindrical. In this way, not only the internal surface of the tubular forming element is pressing against the filter material, but also the external surface of the pin forms a guide for the filter material travelling within the tubular forming element. The filter material therefore forms a sleeve when compressed between the internal surface of the channel of the tubular forming element and the external surface of the pin. The external diameter of the filter body exiting the forming device is a function of the internal diameter of the channel of the tubular forming element, while the diameter of the through hole of the filter body is a function of the diameter of the pin.

Further, the apparatus for manufacturing filters comprises a diameter changing device, adapted to vary the pin diameter of the pin, so as to obtain a filter body having a through hole of variable diameter. The diameter changing device is adapted to modify the diameter of the pin so that, when the filter material is travelling inside the tubular forming element, the distance between the inner surface of the channel and the outer surface of the pin can be varied and therefore the thickness of the wall of the sleeve formed by the filter body can be varied as well. Filter body having different diameters of their inner through hole can be therefore formed. Preferably, the outer diameter of the filter body remains constant, only the inner diameter of the through hole changes. The change in diameter of the pin can take place without interrupting production and without the need of additional elements such as additional pins of different diameters. The change in diameter can take place in the apparatus of the invention for example when a filter for a different end product is desired.

As used herein, the term "rod" is used to denote a generally cylindrical element of substantially circular, oval or elliptical cross-section.

As used herein, by "diameter" is meant the maximum transverse dimension of components, or portions of components, of the apparatus or of the filter material or of the filter body.

The pin diameter may preferably vary between about 1 millimeter and about 5 millimeters, more preferably between about 2 millimeters and about 4 millimeters.

Preferably, the diameter changing device includes a heat generator connected to the pin and adapted to change a pin temperature in order to change the pin diameter. A heat generator adapted to change a pin temperature may change the diameter of the pin by thermal expansion. Thermal expansion is the tendency of matter to change in volume in response to a change in temperature, through heat transfer. The degree of expansion divided by the change in temperature is called the material's coefficient of thermal expansion and generally varies with temperature. Thus, the amount of expansion or contraction of the pin, and thus its diameter's changes, can be determined or selected knowing or selecting the material in which the pin is realized. To a given temperature change, a given diameter change is given.

More preferably, the pin is formed in a material comprising a metal. As known, metals have a rather large coefficient of thermal expansion; therefore a pin made of metal may vary its diameter in a relatively broad range of values for a relatively "narrow" range of temperatures. Too high temperature may damage the filter material in contact to the pin while traversing the tubular element; therefore temperatures of the pin which only affect in a negligible way the filter material are preferred.

More preferably, the pin is formed in steel, even more preferably in carburized steel. The pin of the filter machine is subject to a continuous wear and friction due to the passage of the filter material into the tubular forming element. This may cause the need of changing the pin after a given production time. It is therefore preferred to realize a pin in a material which is resistant to wear. Steel is one of these materials. Further, carburization is a heat treatment process in which iron or steel absorbs carbon liberated when the metal is heated in the presence of a carbon bearing material, such as charcoal or carbon monoxide, with the intent of making the metal harder. The resistance of the pin may be further improved using a pin made of carburized steel and the number of production interruptions to change a worn-out pin may be diminished.

Preferably, the pin defines an external surface adapted to be in contact with the filter material, and wherein the diameter changing device comprises at least two protrusions adapted to be retractable or extendable along a radial direction from the external surface of the pin. More preferably, the diameter changing device comprises at least three protrusions. In order to change the diameter of the pin, the pin may be construed as a micrometer, such as a bore micrometer. The pin may comprise at least two protrusions, angularly spaced one from the other, which protrudes from the external surface of the pin itself, towards the inner surface of the channel defined in the tubular forming element. Changing the radial height of the protrusions change the diameter of the pin as felt by the passing filter material. Preferably the number of protrusions is at least three so that they can be angularly spaced around the whole pin at a regular distance.

Retractable or expandable in a radial direction means that the protrusions can change their length, increasing or decreasing it, along a line departing from the longitudinal axis of the pin and extending perpendicularly to it.

More preferably, the diameter forming device includes a micrometric screw and wherein at least one of the protrusions is adapted to be retractable or extendable by means of the micrometric screw. In this way, the diameter of the pin may be changed with accuracy.

The filter manufacturing apparatus advantageously further comprises a plasticizer addition unit arranged upstream an inlet of the tubular forming element and adapted to spout a plasticizer to add the plasticizer to the filter material. In order to obtain a substantially stiff filter body which keeps its shape without deforming or with limited deformation, a plasticizer may be introduced in the filter material in order to bond together the filter fibers. In order to render the filter body stiff and with a substantially constant shape, so that, although the body is hollow, it does not deform very easily and it preferably keeps its rod-like shape, a heat source adapted to heat the filter material passing in the tubular forming element may be also provided, so that the bonding material such as the plasticizer present within the filter material provides for the bonding among the fibers of the filter material. Plasticizers are additives that increase the plasticity or fluidity of a material. The heat source is preferably a steam source such as a water steam source, which sprays or otherwise injects steam inside the tubular forming element.

Preferably, the filter manufacturing apparatus comprises a heat treating section adapted to heat the filter material while the filter material passes through the tubular forming element. More preferably, the heat treating section comprises a steam generator fluidly connected to the tubular forming element to supply steam to the filter material. The heat transfer is used to bond the plasticizer to the filter fibers of the tow. As a heat source, hot air may be used, or an electrically heated wire or steam or microwave. In this regard, superheated steam or water vapor has been found to be particularly suitable. Due to its relatively high heat capacity of superheated steam is a particularly effective heat transfer. By the combined action of the pressure applied to the filter material stream in the tubular forming element and the heat, at least partial solidification of the filter material is obtained to realize a rod-like filter body. In order to apply as a heat source the process fluid, opening out intake ports are provided for example in the tubular forming element for introducing the process fluid.

Advantageously, the filter manufacturing apparatus comprises a cooling section located downstream the forming device to cool down the hollow rod-shaped filter body. In the forming device, heat is transferred to the continuous filter body in order to bind the filter material due to the plasticizer presence. In order to speed up the process of filter formation, the heat from the filter body needs to be dissipated as quickly as possible in order to obtain a final filter body apt to be further processed. In order to cool the filter body as quickly as possible, a cooling section is provided. The cooling also improves the surface quality of the filter body. Cooling of the hollow filter body downstream of the forming device may be performed with an air flow at room temperature, for example in a pressure range of about 0.4 bar to about 1 bar, more preferably at about 0.5 bar.

Preferably, the filter manufacturing apparatus comprises a wrapping section located downstream the forming device to wrap the hollow filter body in a wrapping sheet. Advantageously, the hollow filter body exiting the forming device is wrapped in wrapping sheet, such as wrapping paper, so that its diameter, which has been checked by the diameter measuring device, cannot further change or can change only of a very limited amount.

More preferably, the wrapping section includes a glue nozzle to distribute glue onto the wrapping sheet so as to close the wrapping sheet around the hollow filter body.

Advantageously, the filter manufacturing apparatus comprises a heating section located downstream the wrapping section to heat up the wrapped hollow filter body. The heating section preferably provided in a location downstream the glue nozzles distributing glue on the wrapping sheet. The glue is preferably used in order to close the wrapping sheet around the filter body firmly, so that it does not "re-open" again. Preferably cold glue is used, which needs heat in order to correctly connect together different portions of the wrapping sheet. Cold glues are commonly water-based solutions. The adhesive solids are dissolved in water, usually by cooking. A bond is formed when almost all of the water is lost via penetration or absorption into substrates, for example by means of heating.

Advantageously, the forming device comprises a tapered portion, the tapered portion having its internal diameter decreasing along the longitudinal transport direction. The tapered portion compresses the filter material so that a rod can be formed by pressure of the inner wall of the tubular forming element.

Preferably, the pin defines an external surface adapted to be in contact with the filter tow material, and wherein the pin comprises a non-stick coating on the external surface of the pin. By using a non-stick coating on the external surface of the pin, which is the guide surface of the filter material when in the tubular forming element, the frictional resistance of the filter material stream during the manufacture of filter rod is significantly reduced.

Advantageously, the pin defines a substantially cylindrical external surface. In this may, a cylindrical hole in the filter body may be formed.

The invention will be further described, by way of example only, with reference to the accompanying drawings in which:

FIG. 1 depicts an apparatus for the production of a hollow filter body, for example to be used as a filter or as a filter component in an aerosol generating article (not depicted in the figures).

Figure 1:
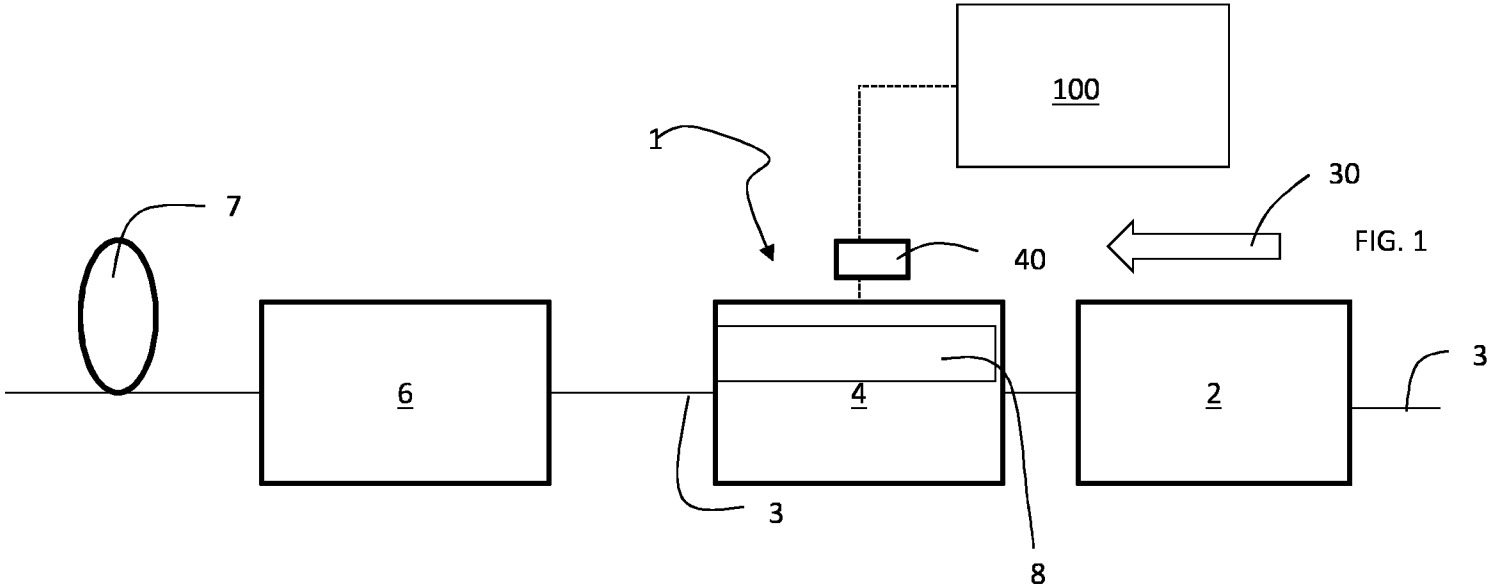
FIG. 1 is a schematic view of an apparatus for forming a filter according to the invention.

Apparatus 1 comprises a transport device 3 to transport along a transport or feeding direction 30 (indicated by arrows in the figures) filter material, for example cellulose acetate or filter tow. The filter tow may be taken from a bundle (not shown). After the withdrawal from the bundle, the filter tow material by means of compressed air from different compressed air nozzles (also not shown) may be loosened up and homogenized.

Further, the apparatus 1 includes an inlet unit 2 adapted to form a continuous stream or strip of filter material, moistened with a hardening fluid or plasticizer, such as triacetin. The filter material is fed to the inlet unit 2 by the transport device 3. The moistening of the filter material with plasticizer takes place in a plasticizer unit, not shown in the drawings and known in the art. The plasticizer unit is located upstream the inlet unit 2.

Figure 3:
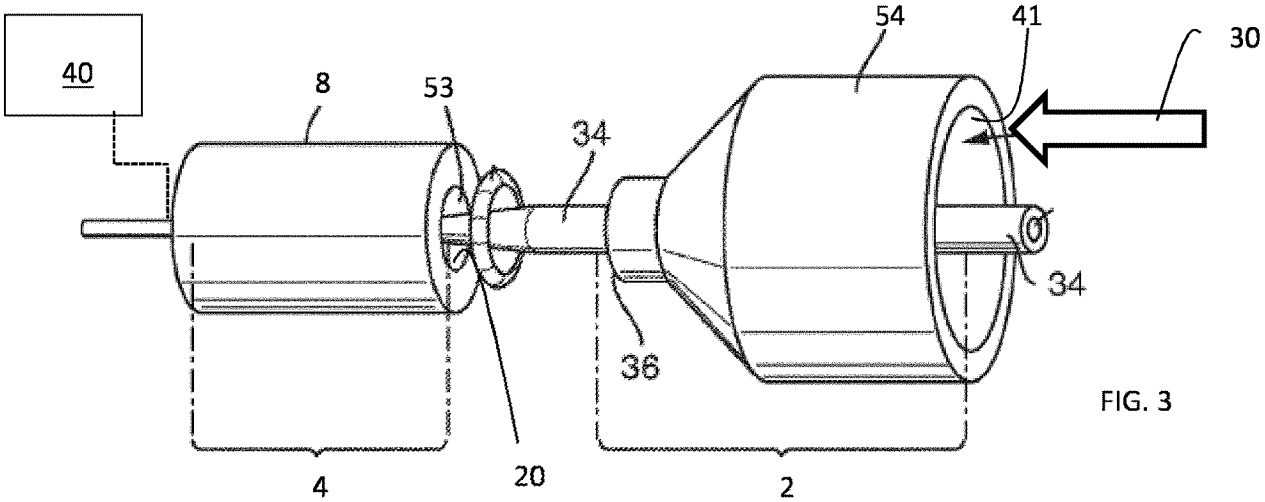
FIG. 3 is a perspective view of a portion of the apparatus of FIG. 1.
Figure 2:
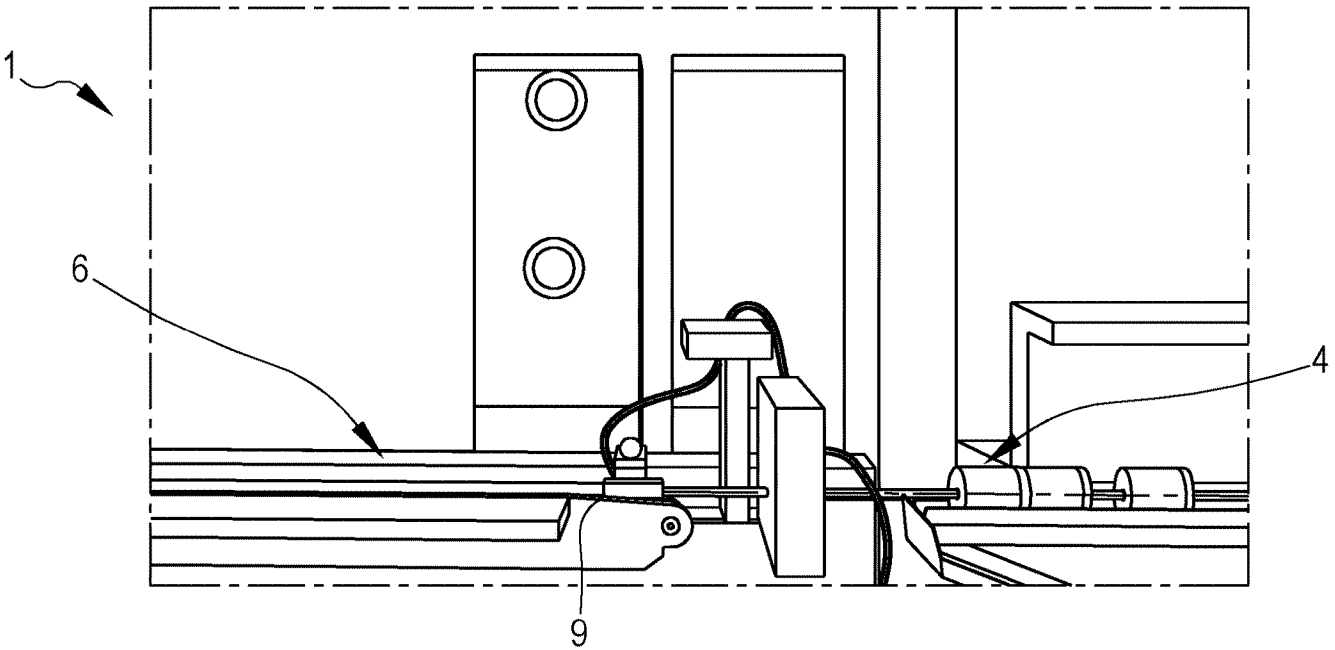
FIG. 2 is a perspective view of a portion of the machine of FIG. 1.

After the impregnation unit, the transport device 3 transports the impregnated filter tow material to the inlet unit 2, which includes preferably a cone-shaped element 54 (see FIG. 3). In the inlet unit 2, the filter tow material is subjected to compressed air. This procedure may cause homogenization of the filter tow material, which is pushed along an interior channel 41 of the inlet unit 2 realized along a longitudinal direction of the inlet unit itself. The interior channel 41 is preferably cylindrically shaped and it defines a longitudinal axis preferably parallel to the transport direction 30.

Downstream the inlet unit 2, the apparatus includes a rod forming unit 4, arranged in series to the inlet unit 2 and adapted to receive the flow or strip of filter material and to cause the hardening material present in the filter material to react to transform the filter material into a continuous axially rigid hollow rod filter body.

Preferably, the hollow filter body exiting the rod forming unit 4 is a non-wrapped acetates filters (NWA filters). In order to avoid an expanding of the rod filter body after shaping it in the rod forming unit 4, without such a wrapping paper presence, such as in standard filters, inside the rod forming unit 4 the filter material receives already during its shaping a sufficiently large stability, so that it is used and processed without the wrapping paper.

The production of such filtering ranks takes place in particular in a pultrusion procedure. During this procedure the filter material stream passes through the rod forming unit 4.

Figure 4:
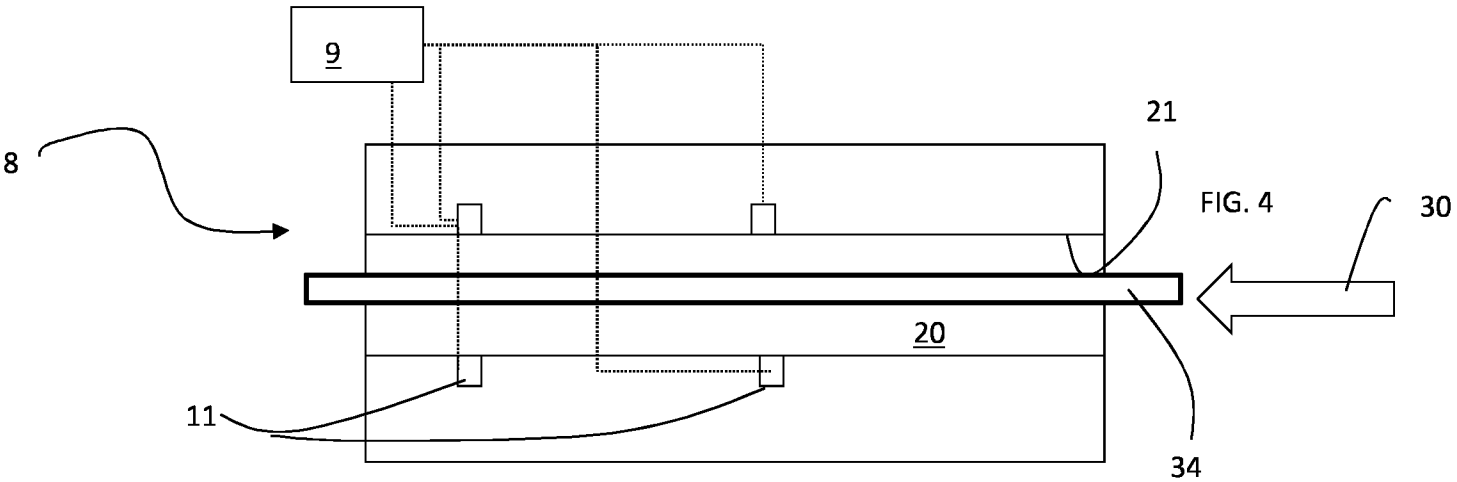
FIG. 4 is a schematic lateral view in section of an element of the portion of FIG. 3.

The rod forming unit 4 comprises a tubular forming element 8, shown in an enlarged view in FIG. 4, adapted to receive the filter material saturated with hardening material, for example along the transport direction 30 depicted in FIG. 4 which is the transport direction of the transport device 3, and to shape the filter material crosswise so as to transform it into a moist, generally cylindrical filter body and to advance the filter body in the feed direction of the mentioned arrow to the further components of the apparatus 1.

Tubular forming element 8 defines a through hole 20 through which the filter material can pass. Preferably, the through hole 20 comprises an inner surface 21 which compresses the filter material to form a substantially cylindrical rod-like shaped continuous strip of material. Further, preferably the tubular element 8 includes a steam generator 9 comprising one or more nozzles 11 which can emit steam in the interior of the tubular element 8. The steam can harden the plasticizer present in the filter material and transform it into the substantially rigid filter rod or body.

The apparatus 1 is adapted for the production of a hollow filter body, that is, of a filter body having a through hole of a desired size, for example of a desired diameter. For this purpose, a guidance pin 34 is located in the interior of the inlet unit 2 and rod forming unit 4. This guidance pin 34 extends in the transport direction 30. In other words, the pin 34 essentially defines a longitudinal extending direction which is substantially parallel to the transport direction 30. Preferably, the pin 34 is coaxial to channel 41 of inlet unit 2 and through hole 20 of the tubular element 8, as shown in FIG. 3. Guidance pin 34 defines a diameter in a cross section perpendicular to the transport direction 30 or axis of the pin. The diameter is selected depending on the desired size of the through hole of the filter body.

Preferably, the pin 34 has an outer surface 36, preferably cylindrical, which is coated in a non-stick coating. The coating could be a plastic or ceramic coating. Preferably, the pin 34 may be realized in metal such as steel and may be surface-treated.

The guidance pin 34 preferably comprises a first section 51 and a second section 53. The first section 51 of the guidance pin 34 extends within the inlet unit 2. The second section 53 of the guidance pin 34 extends within the rod forming unit 4. First and the second section 51, 53 are one connected to the other and in particular they are along the same longitudinal axis. Preferably the pin 34 defines an outer substantially cylindrical surface.

A length of the guidance pin 34 measured in transport direction 30 is thus longer than a length of the interior of the inlet unit 2 and of the rod forming unit 40 measured in same direction.

Preferably the filter material is pushed inside the tubular element 8 along arrow 30 by means of a fluid jet, for example a pressurized air jet, generated by a pressurized fluid generator (not shown in the drawings).

Advantageously, the apparatus 1 further includes a wrapping unit 6, to wrap the hollow rod filter in a wrapping paper 90. Further, the apparatus may comprise a cutting unit 7, normally a rotating cutting head of known type, arranged downstream of the rod forming unit 4 and wrapping unit 6 and adapted to cut the hollow filter rod crosswise into filter segments (not shown). The desired length of the units in which the filter body is cut is for example obtained with the assistance of a measurer apparatus (also not shown). The cut units are made available in following processing steps or are buffered.

Wrapping unit 6, transport device 3 and cutting unit 7 are known in the art and not further detailed below.

Figure 5:
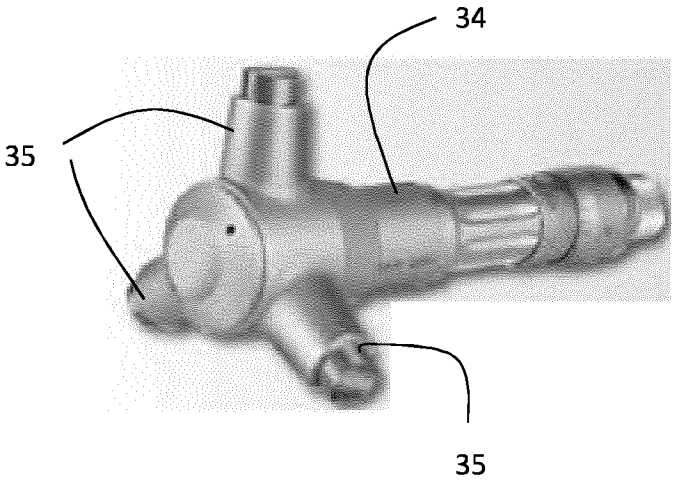
FIG. 5 is a perspective view of the element of FIG. 4.

Further, the apparatus 1 includes a diameter changing device 40. The diameter changing device, schematically shown in FIGS. 1 and 3, is connected to the pin 34 in order to change the diameter of the same. Diameter changing device 40 may include a heat generator so as to change the temperature of the pin. In FIG. 5, a different embodiment of the pin 34 and diameter changing device 40 is shown. Pin 34 includes a plurality of protrusion 35 departing from its outer surface 36 and angularly spaced. The protrusion, with the aid of the diameter changing device, may be expanded or retracted in the radial direction. The length of protrusions 35 defines the diameter of the pin 34.

Apparatus 1 may also include a central control unit 100. Central unit 100 is adapted to command the rod forming unit 4. Preferably, central unit 100 commands the steam generator 9 and the pressurized fluid generator (not visible in the drawings). The central unit 100 is adapted to change the pressure of the steam produced by the steam generator and, in alternative or in addition, the pressure of the fluid pushing the filter material into the tubular forming element 8. Central control unit 100 is also adapted to command diameter changing device 40 in order to properly change the diameter of the pin 34.

The functioning of the apparatus 1 is as follows. According to the specification of the desired filter body to be produced, the diameter adjusting device is regulated, for example imputing a desired diameter of the pin 34, and the pin 34 reaches the desired inputted diameter. The filter tow is transported along the transporting direction 30 and a plasticizer is added to it. By means of compressed air it is then inserted into the inlet unit 2, and in particular in the cone-like element, where it is shaped around the pin 34, that is, it is compressed between the pin 34 outer surface and the inner surface of channel 41. As previously mentioned, the filter tow is transported along the interior of the inlet unit 2 by means of compressed air along transport direction 30, preferably parallel to the axis of channel 41, and homogenized at the same time. For this purpose, the inlet unit 2 may include compressed air ports not represented. The filter tow distributes itself under the influence of compressed air evenly around the pin 34. At an outlet 36 of the inlet unit 2, a filter material stream emerges, which surrounds the pin 34.

The filter material stream enters the tubular forming element 8, in which a sleeve-like channel is defined between the internal surface 21 of the through hole 20 and the external surface of the pin 34. The channel likewise essentially extends in transport direction 30. Inside the channel of the tubular forming element, nozzles 11 introduces the fluid, such as steam, from steam generator 9 serving as sources of energy. In particular hot-air or superheated steam is used as process fluid. The filter material stream 22 existing from the tubular forming element 8 is solidified by effect of the warmth transported by the process fluid, so that a non-wrapped hollow tubular body is manufactured. The hollow filter body can possibly also undergo a further wrapping step in a wrapping unit, not further described and considered standard in the field.

The shaping of the hollow filter body takes place by means of the effect of the internal surface 21 of the through hole 20 of the tubular forming element 8 on the one hand and of the opposite outside surface 36 of the second section 53 of the guidance pin 34 on the other hand. These two surfaces 21, 36 acts as guide surfaces for the filter material stream and form together the format channel for the shaping of filter material.

The format channel is substantially shaped as a mantel or sleeve. The selected pin diameter defines the dimension of the through hole of the filter body, that is, the "thickness" of the channel. Preferably, the dimension of the internal surface 21 remains constant, and only the dimension of the outside surface 36 is changed.

Advantageously, when a different hollow filter body is desired, for example a hollow filter body having a different diameter of its through hole, the diameter of the pin 34 is changed, acting on the diameter changing device 40. For example, the temperature of the pin may be changed, or the extension of protrusions 35 may be varied, and a new diameter can be set. The filter material entering the apparatus 1 after the diameter change of the pin is subjected in the inlet unit 2 and in the rod forming unit 4 to the new pin diameter and therefore a new hollow filter body is produced.

The invention claimed is:

1. A filter manufacturing apparatus adapted to form a hollow filter body, the filter manufacturing apparatus comprising:

a feed path adapted to continuously feed a filter material along a longitudinal transport direction;

a forming device connected to a terminating end of the feed path and adapted to form the filter material into a hollow rod-shaped filter body and deliver the hollow rod-shaped formed filter body, the forming device including:

a tubular forming element adapted to allow the filter material to pass therethrough, a pin extending longitudinally within the tubular forming element, the pin having a pin diameter;

a diameter changing device, adapted to vary the pin diameter of the pin, so as to obtain a hollow rod-shaped filter body having a through hole of variable diameter.

2. The filter manufacturing apparatus according to claim 1, wherein the diameter changing device includes a heat generator thermally connected to the pin and adapted to change a pin temperature in order to change the pin diameter.

3. The filter manufacturing apparatus according to claim 1, wherein the pin is formed in a material comprising a metal.

4. The filter manufacturing apparatus according to claim 3, wherein the pin is formed in steel.

5. The filter manufacturing apparatus according to claim 4, wherein the pin is formed in carburized steel.

6. The filter manufacturing apparatus according to claim 1, wherein the pin defines an external surface adapted to be in contact with the filter material, and wherein the diameter changing device comprises at least two protrusions adapted to be retractable or extendable along a radial direction of the external surface.

7. The filter manufacturing apparatus according to claim 6, wherein the diameter changing device comprises at least three protrusions.

8. The filter manufacturing apparatus according to claim 6, wherein the diameter forming device includes a micrometric screw and wherein at least one of the protrusions is adapted to be retractable or extendable by means of the micrometric screw.

9. The filter manufacturing apparatus according to claim 1, comprising:

a plasticizer addition unit arranged upstream an inlet of the tubular forming element and adapted to spout a plasticizer to add the plasticizer to the filter material.

10. The filter manufacturing apparatus according to claim 1, comprising:

a heat treating section adapted to heat the filter material while the filter material passes through the tubular forming element.

11. The filter manufacturing apparatus according to claim 10, wherein the heat treating section comprises a steam generator fluidly connected to the tubular forming element to supply steam to the filter material.

12. The filter manufacturing apparatus according to claim 1, comprising:

a cooling section located downstream the forming device to cool down the hollow rod-shaped filter body.

13. The filter manufacturing apparatus according to claim 1, wherein the forming device comprises a tapered portion, the tapered portion having its internal diameter decreasing along the longitudinal transport direction.

14. The filter manufacturing apparatus according to claim 1, wherein the pin defines an external surface adapted to be in contact with the filter tow material, and wherein the pin comprises a non-stick coating on the external surface of the pin.

15. The filter manufacturing apparatus according to claim 1, wherein the pin defines a substantially cylindrical external surface.

* * * * *